US005903201A

United States Patent [19]

Reiss

[11] Patent Number: 5,903,201

[45] Date of Patent: May 11, 1999

[54] RELAY FOR HIGH BREAKING CAPACITIES

[75] Inventor: Heiko Reiss, Berlin, Germany

[73] Assignee: Siemens Aktiengesellschaft, Munich, Germany

[21] Appl. No.: 08/930,074

[22] PCT Filed: Jun. 12, 1996

[86] PCT No.: PCT/DE96/01033

§ 371 Date: Nov. 6, 1997

§ 102(e) Date: Nov. 6, 1997

[87] PCT Pub. No.: WO97/01182

PCT Pub. Date: Jan. 9, 1997

[30] Foreign Application Priority Data

Jun. 23, 1995 [DE] Germany ..... 195 22 931

[51] Int. Cl.[6] ..... H01H 67/02

[52] U.S. Cl. ..... 335/128; 335/83; 335/80

[58] Field of Search ..... 335/78–86, 124, 335/128, 202

[56] References Cited

U.S. PATENT DOCUMENTS

| | | | |
|---|---|---|---|
| 3,980,978 | 9/1976 | Lacan | 335/132 |
| 4,924,197 | 5/1990 | Siepmann | 335/128 |
| 5,027,094 | 6/1991 | Yasuoka et al. | 335/78 |
| 5,070,315 | 12/1991 | Kuzukawa et al. | 335/128 |
| 5,155,459 | 10/1992 | Schmid et al. | 335/128 |
| 5,677,655 | 10/1997 | Hinata et al. | 335/132 |

FOREIGN PATENT DOCUMENTS

| | | |
|---|---|---|
| 0 195 956 | 10/1986 | European Pat. Off. . |
| 0 281 950 | 9/1988 | European Pat. Off. . |
| 2 436 490 | 4/1980 | France . |
| 19 80 807 | 3/1968 | Germany . |
| 34 28 595 | 2/1986 | Germany . |

*Primary Examiner*—Lincoln Donovan
*Attorney, Agent, or Firm*—Hill & Simpson

[57] ABSTRACT

The relay has a magnetic system with a coil (2), a core (4), a yoke (5) and also an armature (6) mounted on the yoke. A contact spring (7) is fastened to the armature and the end section of said spring interacts with one or more mating contact elements. The contact spring (7) and/or each mating contact element (21, 22, 25, 26) are connected to connection elements which are all anchored in a common plane in separate pockets (33, 34, 35) of an insulating wall (32) on that side of the coil which is opposite the second yoke limb.

11 Claims, 4 Drawing Sheets

FIG 1
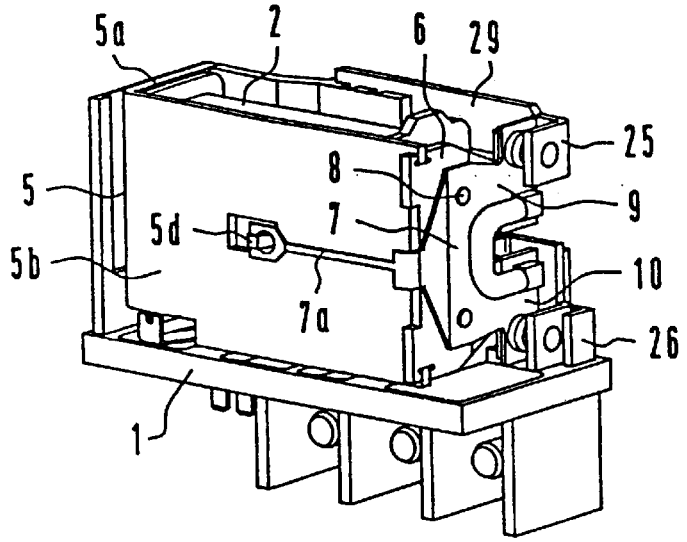
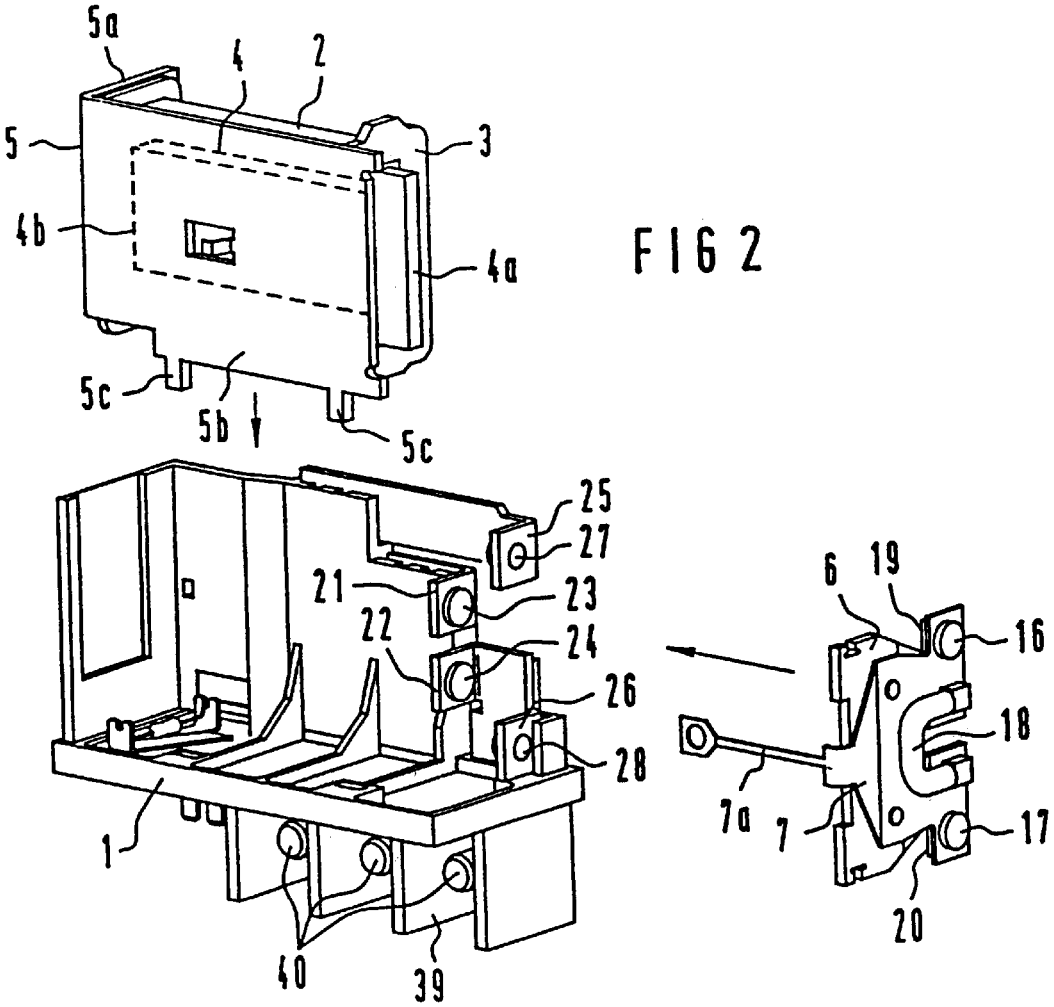
FIG 2

RELAY FOR HIGH BREAKING CAPACITIES

BACKGROUND OF THE INVENTION

This invention relates to an electromagnetic relay. A relay described in European reference EP 0 281 950 B1. This structure makes it possible to configure different contact complements with a fundamental structure that remains the same, the connection configuration of the blade terminals on the underside of the base being distributed in a manner corresponding to the standards for motor vehicle relays. The insulation between the load connections and with respect to the coil is problematic here for use with the purpose of switching very high currents. A similar relay is described in European reference EP 0 195 956 B1. The spring arms of that document's contact spring are connected by means of a multiple-stranded copper wire; the possibility of a double changeover is also mentioned there, in each case two contact pieces situated coaxially opposite one another being arranged on each spring arm and being connected to one another in each case through a hole in the contact spring. However, such a structure with two large contact rivets for the switching of very high currents and with the intervening material of the contact springs, on the one hand, and of the multiple-stranded copper wire, on the other hand, would lead to a very large thickness in the axial direction of the contact pieces, which would be very difficult to control during production of the contact spring. In addition, the total height of the contact pieces would also be subject to large tolerances, which would lead to complicated measures for adjusting the contact separations.

SUMMARY OF THE INVENTION

The aim of the present invention is to configure a relay of the type mentioned in the introduction in such a way that, in spite of simple production and with a narrow and compact structure, it is suitable for switching very large switching powers on and off and/or over, it also being possible to realise the requisite insulation of the load connections in a simple manner.

This aim is achieved according to the invention in that all of the load connection elements are anchored with their main plane in a common plane, which is perpendicular to the basic plane, on that side of the coil which is opposite to the second yoke limb, and extend in this common plane to the underside of the base.

The construction according to the invention makes it possible to achieve a very narrow and compact structure, it being possible to improve the insulation of the load connection elements with respect to the coil by means of an insulating wall standing perpendicularly on the bottom side of the base. In this case, the load connection elements can either be embedded in the material of the base or be guided in mutually isolated pockets of the base of the insulating wall to the bottom side of the relay, where they preferably terminate in mutually insulated chambers.

In an advantageous refinement, the relay according to the invention is designed as a bridge contact relay, the contact spring, which is fastened to the armature, being split in a forked manner into two spring arms at its free end section projecting over the moveable end of the armature, it being possible for each of the spring arms to be respectively switched over between two stationary mating contact elements and the two spring arms being connected together by means of a conductor strip made of highly conductive metal; in this case, each of the two spring arms carries, on its moveable end section, two contact pieces on opposite surfaces, which contact pieces are offset with respect to one another in the transverse direction of the contact spring, and those contact pieces of the two spring arms which are aligned with one another on the same surface side respectively interact with a mating contact pair as bridge make contact and as bridge break contact, respectively.

As a result of this offset arrangement of the make-contact contact pieces with respect to the break-contact contact pieces on the common changeover spring, the production process is facilitated, the total contact height on the spring surface is reduced, even when the individual contact pieces are connected together by multiple-stranded wires or strips made of highly conductive material, and, in particular, it is not necessary to fit any contact rivets coaxially against one another. The offset arrangement also enables equalization in the arrangement of the mating contact elements, which, in this way, can also be fastened with favorable utilization of space and mutual insulation and be guided to the connection side of the relay.

In an advantageous refinement, it is furthermore provided that those contact pieces of the two spring arms which are adjacent to the longitudinal axis of the contact spring are arranged on the same surface side, preferably toward the armature, with the result that they form the contacts of the make contact, while the respective outer contact pieces are likewise arranged on the same surface side, namely preferably directed away from the armature, and accordingly form the contacts of the break contact. This has the advantage that the contacts of the break contact experience a softer spring characteristic when they are deflected, due to their greater distance from the longitudinal axis of the armature and due to the effective torsion of the spring.

In general terms the present invention is an electromagnetic relay having a base, which defines a bottom side of the relay. A coil is arranged on the base with its axis parallel to the bottom side. A core axially penetrates the coil. A yoke is connected by a first limb to one end of the core and extends with a second limb on a long side next to the coil. An armature is mounted on the free end of the second yoke limb and forms an operating air gap with the other end of the core. A contract spring is actuated by the armature and interacts with at least one mating contact element. The contact spring and/or each mating contact element is respectively connected to one of a number of load connection elements anchored in the base. All of the load connection elements are anchored with their main planes in a common plane, which is perpendicular to the basic plane, on that side of the coil which is opposite to the second yoke limb, and extend in this common plane to the underside of the base.

Advantageous developments of the present invention are as follows.

Each of the load connection elements leads, at the underside of the base into a dedicated connection chamber, which is isolated from the others by insulating walls.

The base forms an insulating wall, which is perpendicular to the bottom side, in the region between the load connection elements and the coil.

The load connection elements are embedded in the base.

The load connection elements are inserted into pockets of the base or of the insulating wall and on the upper side form the respective mating contact elements by different angling using lengthened portions which project to different heights from the respective pockets.

Contact bolts each of which are arranged parallel to one another and to the basic plane. They are fastened to the load connection elements in the region of the underside of the base. The contact spring, which is fastened to the armature, is split in a forked manner into two spring arms at its free end section projecting over the moveable end of the armature. Each of the spring arms can be respectively switched over between two stationary mating contact elements. The two spring arms are connected together by means of a conductor strip mad of highly conductive metal. Each of the two spring arms carries, on its moveable end section, two contact pieces on opposite surfaces. The contact pieces are offset with respect to one another in the transverse direction of the contact spring. Those contact pieces of the two spring arms are aligned with one another on the same surface side respectively interact with a mating contact pair as bridge make contact and as bridge break contact, respectively.

Each of the two spring arms is configured in a T-shaped or L-shaped manner with a transverse limb and carries the contact pieces on the transverse limb. The inner contact pieces, adjacent to the longitudinal axis of the contact springs, of the two spring arms are seated on that surface of the spring which faces the armature, and form the bridge break contact, while the outer contact pieces of the two spring arms are seated on that surface of the spring which faces away from the armature and form the bridge break contact.

The contact pieces adjacent to the longitudinal axis of the contact spring of the two spring arms are connected to one another on their rear side by means of a preferably U-shaped multiple-stranded wire. The contact pieces respectively fastened on one spring arm are connected together by a conductor rail in each case on that surface of the spring which is opposite to the multiple-stranded wire.

One of the make-contact mating contact elements is connected in one piece to one of the break-contact mating contact elements via a common connection element.

The contact spring connected to a load connection element forms a make contact together with a mating contact element.

The contact spring provided with two spring arms forms a bridge make contact together with two mating contact elements.

The contact spring connected to a load connection element forms a changeover contact together with two mating contact elements.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

FIG. 1 shows a perspective view of a relay configured according to the invention (without a housing cap), FIG. 2 shows the main assemblies of the relay of FIG. 1, namely the base assembly, the coil assembly and the armature assembly, in a perspective view as they are being assembled.

DESCRIPTION OF PREFERRED EMBODIMENTS

Figure 3:
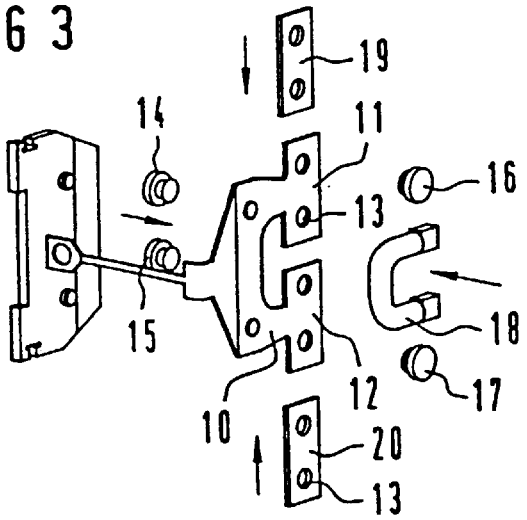
FIG. 3 shows an exploded illustration of the armature assembly with the contact spring in individual parts.
Figure 4:
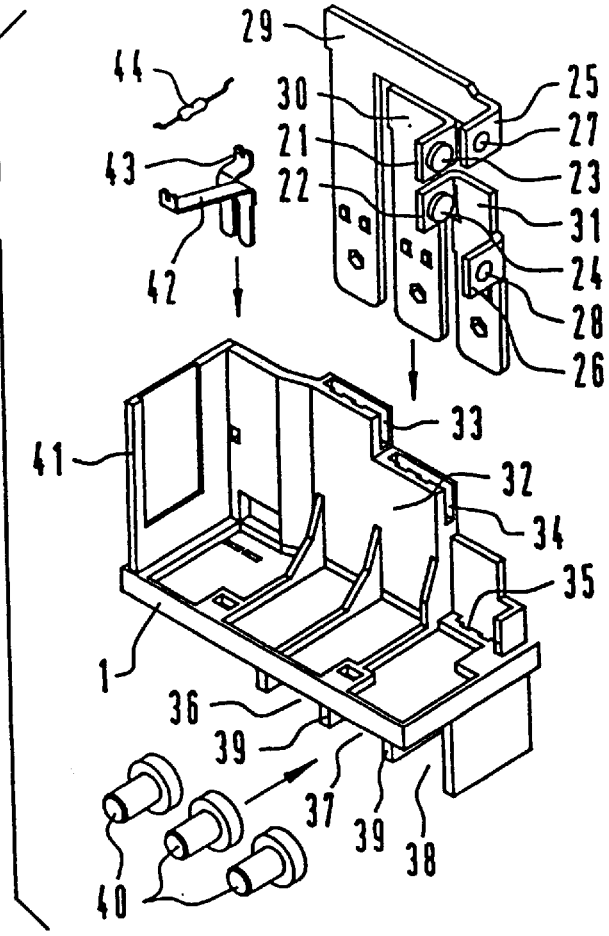
FIG. 4 shows an exploded illustration of the base assembly likewise in individual parts.

The relay illustrated in FIGS. 1 to 4 has a base 1, which defines the bottom side and the connection plane of the relay. A magnetic system with a coil 2, which is carried by a coil former 3, a core 4 arranged axially in the coil and an angular yoke 5 is arranged on this base, the coil axis being parallel to the bottom side of the base 1. The coil is arranged standing on edge with a rectangular or oval cross section on the base, thereby producing a narrow design of the relay. The core 4 is indicated partially by dashed lines in FIG. 2, since it is not visible within the coil. It has a T-shaped cross section with a widened pole end 4*a*, as a result of which an enlarged pole face is obtained. If required, it could be also additionally be upset. The other core end 4*b* is connected to a first yoke limb 5*a*, while the second yoke limb 5*b* extends on the long side next to the coil 2. The yoke 5 stands perpendicularly with its main sheet-metal planes of the two limbs 5*a* and 5*b* on the bottom side of the base 1. In addition, two fastening pins 5*c* are integrally formed, pointing downward on the yoke limb 5*b*, which pins are used to fasten the magnetic system and, for example, can be slotted into cutouts in the base 1.

The magnetic system is completed by an armature 6, which is mounted on the free vertical edge of the yoke limb 5*b* and forms an operating air gap with the pole end 4*a* of the core. A contact spring 7 is fastened to the armature, for example by means of rivets 8 or welds. It simultaneously acts as a restoring spring and is suspended by a restoring arm 7*a* from a holding pin 5*d* of the yoke limb 5*b*. In this respect, the spring corresponds to known systems.

The contact spring 7 is split in a forked manner into two spring arms 9 and 10 at its free end section which projects over the moveable end of the armature 6. In addition, each of the spring arms is in turn provided with a transverse limb 11 and 12, respectively, at its free end, with the result that the overall shape imparted to each of the said arms is a T-shape, Of course, an L-shape would also be conceivable. Both transverse limbs 11 and 12 are in each case provided with two holes 13 for receiving contact pieces. These contact pieces are fitted to the transverse limbs in each case from different sides. Thus, the contact pieces 14 and 15 are respectively fitted on the inner ends, facing one another, of the transverse limbs 11 and 12, on the side facing the armature, with the result that they form contacts of a make contact, Correspondingly, outwardly directed contact pieces 16 and 17 are fitted as break-contact contact pieces on the outer ends of the transverse limbs 11 and 12.

All of the contact pieces are, moreover, connected together by means of connecting elements made of highly conductive material, preferably copper. This enables the switching and carrying of high currents without it being necessary to design the contact spring 7 itself for the carrying of these high currents. Said spring may therefore be composed of a spring material of relatively low conductivity, for example steel, and thus be configured only with regard to the necessary spring properties. For the purpose of carrying currents, the contact pieces 14 and 15 are connected by means of a U-shaped multiple-stranded copper wire 18, which thus also connects the two springs 11 and 12 in a flexible manner and with high conductivity. The contact pieces 14 and 16 on the transverse limb 11 are connected by means of a copper rail 19 and the contact pieces 15 and 17 on the transverse limb 12 are connected via a copper rail 20, both connections being of a highly conductive nature.

The contact spring with its four moveable contact pieces 14, 15, 16 and 17 co-operates with four mating contact elements, namely the make-contact mating contact elements 21 and 22 with the contact pieces 23 and 24 as well as with the break-contact contact elements 25 and 26 and their contact pieces 27 and 28. The mating contact elements are in each case anchored in the base 1 via a connection element, namely the mating contact element 25 via a connection element 29, the mating contact element 21 via a connection element 30 and the mating contact elements 22 and 26 via a common connection element 31. Since this connection element 31 is connected both to a contact of a make contact and to a contact of a break contact, a changeover function results for the relay. However, a make-contact and/or a break-contact function would also be conceivable given separation of the connections.

The connection elements 29, 30 and 31 all lie in one plane and are matched to one another by corresponding length and angling in such a way that the stationary contact elements 21, 22 25 and 26 are situated opposite the corresponding contact pieces of the contact spring 7. For the purpose of insulated fastening in the base 1, said base has an insulating wall 32, which is perpendicular with respect to the bottom side and has for the individual connection elements vertical pockets 33, 34 and 35 which are open upward in correspondingly stepped wall elements. In this way, the connection elements are additionally insulated with respect to the coil 2. At the underside of the base, these pockets 33, 34 and 35 lead into corresponding connection chambers 36, 37 and 38, which are shielded and insulated from one another by partitions 39 of the base 1. Thus, the connection element 29 leads into the connection chamber 36, the connection element 30 into the connection chamber 37 and the connection element 31 into the connection chamber 38. In the region of these connection chambers, the connection elements are provided with studs 40 perpendicular to their main plane, which studs serve as cable connections. Of course, other connection forms would also be conceivable. The studs 40 are connected to the connection elements 29, 30 and 31 by riveting in or pressing in, for example.

The robustness of the base 1 is further increased by an additional end wall 41, which stands at right angles to the insulating wall 32 perpendicularly to the basic plane or the bottom side. A closed housing is formed by placing a cap, not illustrated, onto the base 1. For the coil 2, coil-connecting elements 42 and 43 are additionally fastened in the base by plugging in, between which elements a further component 44 is connected, for example a diode.

During assembly, in accordance with FIG. 2 first of all the stationary mating contact elements and their connection elements 29, 30 and 31, and in addition the connection elements 42 and 43 and the component 44 as well, are mounted on the base 1. The magnetic system with the coil 2 and the yoke 5 is placed onto this base assembly and fastened. The armature 6 with the contact spring 7 is mounted on the magnetic system, with the result that the make-contact contact pieces 14 and 15 are situated opposite the stationary contact pieces 23 and 24, while the break-contact contact pieces 16 and 17 are situated opposite the stationary contact pieces 27 and 28.

The arrangement of the contacts of the make contact on the inner side of the spring arms 11 and 12 and the corresponding arrangement of the contacts of the break contact on the outer side has the further advantage that a softer spring characteristic becomes effective for the break contacts by way of the torsion of the spring. When the armature closes, moreover, the spring arms 9 and 10 can flex more softly in the longitudinal direction, since, owing to the arrangement of the rivets 8 offset toward the rear, said arms can be moved freely away from the armature edge during the closing movement.

Figure 5:
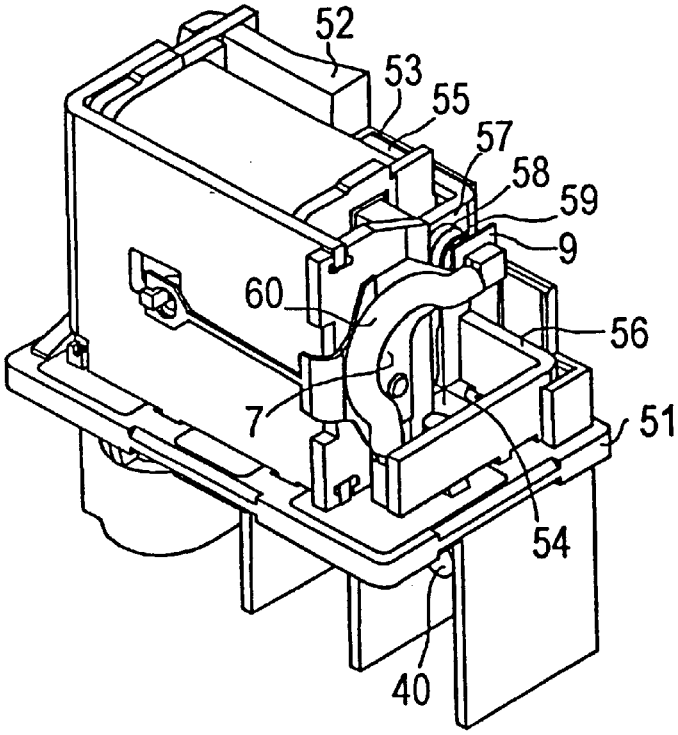
FIG. 5 shows an illustration corresponding to FIG. 1 of a relay with a make-contact contact arrangement.
Figure 6:
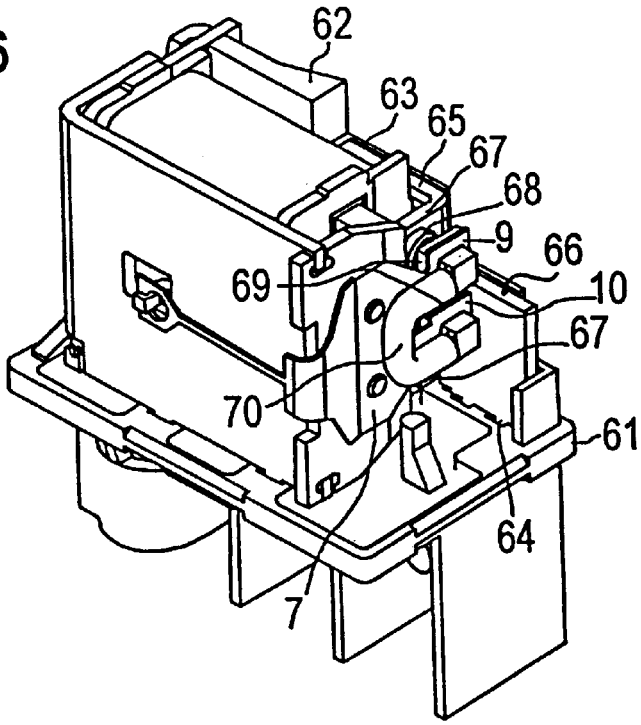
FIG. 6 shows an illustration corresponding to FIG. 1 of a relay with a bridge-make-contact contact arrangement.
Figure 7:
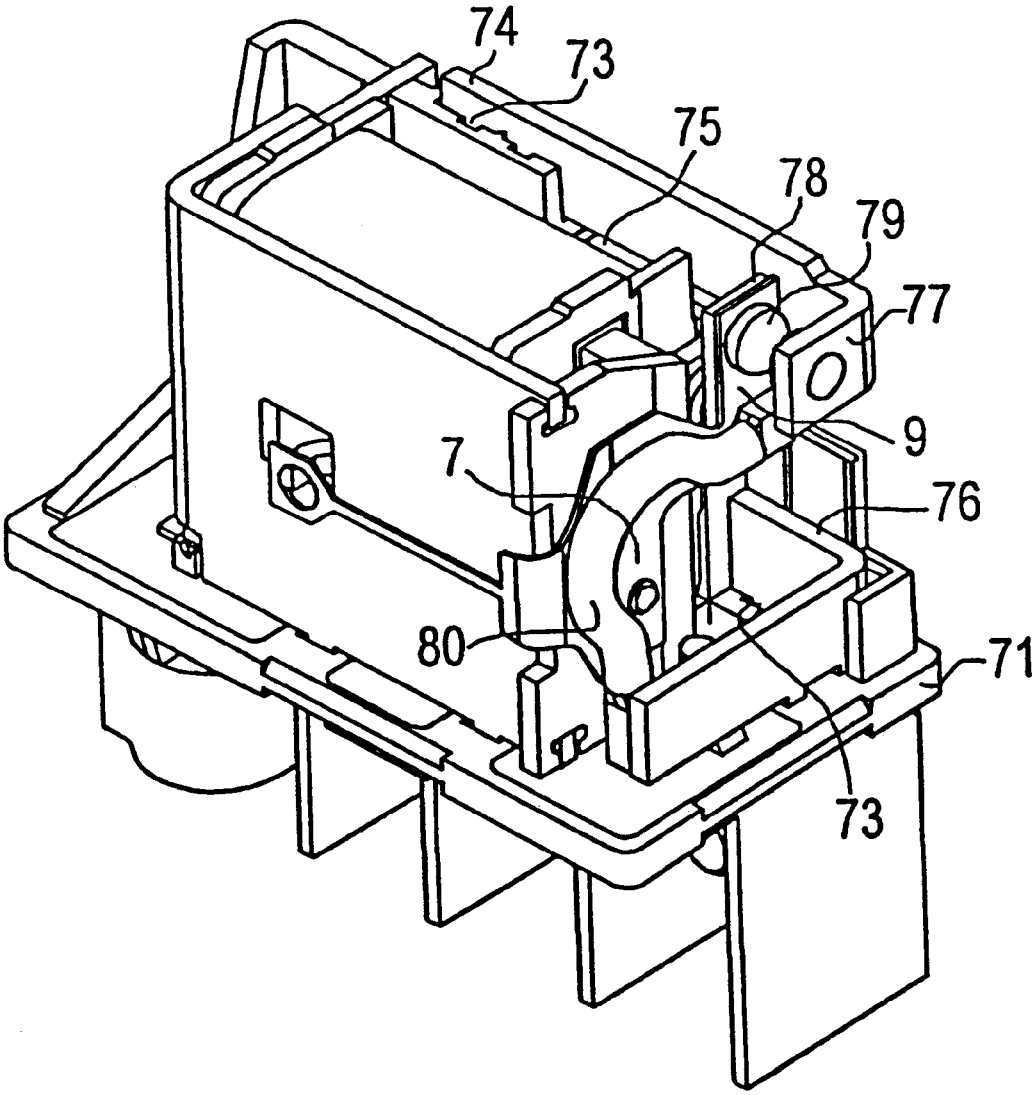
FIG. 7 shows an illustration corresponding to FIG. 1 of a relay with a single-changeover-contact contact arrangement.

FIGS. 5 to 7 illustrate further refinements of the relay according to the invention with different contact arrangements. With the structure of the relay, in particular of the magnetic system, otherwise remaining the same, as in FIG. 1 the relay according to FIG. 5 has a simple make-contact contact arrangement, the contact spring 7 in this case having just the one spring arm 9. A base 51 is constructed in essentially the same way as the base 1, with the difference that it has, in a lateral insulating wall 52, only two pockets 53 and 54 for receiving connection elements 55 and 56. The connection element 55 forms a mating contact element 57 with a stationary contact piece 58, which interacts with a moveable contact piece 59 of the spring arm 9. This spring arm 9 in turn is connected in a readily current-conducting manner to the connection element 56 by means of a multiple-stranded wire 60. As in a preceding example, in this case, too, the connection elements 55 and 56 in the pockets 53 and 54, respectively, are guided in a manner insulated from one another but in one plane to the underside of the base, where they are provided with corresponding studs 40 in connection chambers which are shielded from one another.

FIG. 6 shows a further modification. In this case, a base 61 has, in an insulating wall 62, two pockets 63 and 64, in each of which a connection element 65 and 66, respectively, is anchored. Each of these connection elements is provided with a mating contact element 67 which is integrally formed in one piece, both of which mating contact elements lie in one plane (only partly visible) and carry a respective stationary contact piece 68. As in FIG. 1, the contact spring 7 has two spring arms 9 and 10, which each have a contact piece 69 mounted on them and are connected together in a readily electrically conductive manner by means of a multiple-stranded wire 70. The rest of this relay is also constructed in the same way as in the preceding examples.

FIG. 7, finally, shows another refinement of the relay as a single changeover contact. In this case, a base 71 has an insulating wall 72 with three pockets 73 (only two of which can be seen) lying in a row for receiving connection elements 74, 75 and 76. The connection elements 74 and 75 in each case form a mating contact element 77 and 78, respectively, while the contact spring 7 can be switched over with a spring arm 9 between the two mating contact elements. The two opposite contact pieces 79 of the spring arm 9 are connected to the connection element 76 by means of a multiple-stranded wire 80. In this case, too, the connection elements 74, 75 and 76 are guided in their pockets 73 to corresponding connection chambers on the underside of the base 71.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An electromagnetic relay, comprising:

a base, which defines a bottom side of the relay;

a coil, which is arranged on the base with its axis of the coil parallel to a bottom side;

a core, which penetrates the coil;

a yoke which is connected by a first limb to a first end of the core and extending with a second limb parallel to the axis of the coil;

an armature mounted on a free end of the second yoke limb an operating air gap with a second end of the core;

a contact spring which is actuated by the armature and interacts with at least one mating contact element, at least one of the contact spring and each mating contact element being respectively connected to one of a number of load connection elements anchored in the base;

all of the load connection elements anchored with main planes thereof in a common plane, the common plane being perpendicular to a basic plane, on a side of the coil which is opposite to the second yoke limb, and the load connection elements extending in this common plane to the underside of the base;

the base forming an insulating wall, which is perpendicular to the bottom side, in a region between the load connection elements and the coil, the load connection elements being inserted into pockets of one of the base and the insulating wall and on an upper side thereof the elements forming respective mating contact elements by different angling using different lengthened portions which project to different heights from respective pockets.

2. The relay as claimed in claim 1, wherein each of the load connection elements extends, at the underside of the base into a dedicated connection chamber, which is isolated from other load connection elements by insulating walls.

3. The relay as claimed in claims 1, wherein the load connection elements are embedded in the base.

4. The relay as claimed in claim 1, wherein contact bolts are each arranged parallel to one another and to the basic plane and wherein the contact bolts are fastened to the load connection elements in a region of the underside of the base.

5. The electromagnetic relay as claimed in claim 1, wherein the relay further comprises the contract spring, which is fastened to the armature, being split into two spring arms in a fork configuration at a free end section projecting over a moveable end of the armature, each of the spring arms being switched between two stationary mating contact elements and the two spring arms being connected together by a conductor strip made of highly conductive metal; and wherein each of the two spring arms having on a moveable end section thereof, two contact pieces on opposite surfaces, which contact pieces are offset with respect to one another in a transverse direction of the contact spring, and wherein contact pieces of the two spring arms which are aligned with one another on a common surface side respectively interact with a mating contact pair as bridge make contact and as bridge break contact, respectively.

6. The relay as claimed in claim 5, wherein each of the two spring arms is configures in a T-shaped or L-shaped manner with a transverse limb and carries the contact pieces on a transverse limb thereof, wherein inner contact pieces, adjacent to a longitudinal axis of the contact springs, of the two spring arms are seated on a surface of the spring which faces the armature, and form the bridge break contact, wherein outer contact pieces of the two spring arms are seated on a surface of the spring which faces away from the armature and form the bridge break contact.

7. The relay as claimed in claim 6, wherein the contact pieces adjacent to the longitudinal axis of the contact spring of the two spring arms are connected to one another on their rear side by a U-shaped multiple-stranded wire, and wherein each of the contact pieces respectively fastened on one spring arm are connected together by a conductor rail on a surface of the spring which is opposite to the multiple-stranded wire.

8. The relay as claimed in claim 5, wherein one of the make-contact mating contact elements is connected in one piece to one of the break-contact mating contact elements via a common connection element.

9. The relay as claimed in claim 1, wherein the contact spring connected to a load connection element forms a make contact together with a mating contact element.

10. The relay as claimed in claim 1, wherein the contact spring provided with two spring arms forms a bridge make contact together with two mating contact elements.

11. The relay as claimed in claim 1, wherein the contact spring connected to a load connection element forms a changeover contact together with two mating contact elements.

* * * * *